US011152713B2

(12) United States Patent
Rodríguez-Cano et al.

(10) Patent No.: US 11,152,713 B2
(45) Date of Patent: Oct. 19, 2021

(54) CORNER ANTENNA ARRAY DEVICES, SYSTEMS, AND METHODS

(71) Applicant: wiSpry, Inc., Irvine, CA (US)

(72) Inventors: Rocío Rodríguez-Cano, Aalborg (DK); Shuai Zhang, Aalborg (DK); Gert Frølund Pedersen, Storvorde (DK)

(73) Assignee: WISPRY, INC., Irvine, CA (US)

( * ) Notice: Subject to any disclaimer, the term of this patent is extended or adjusted under 35 U.S.C. 154(b) by 170 days.

(21) Appl. No.: 16/240,260

(22) Filed: Jan. 4, 2019

(65) Prior Publication Data

US 2019/0214739 A1 Jul. 11, 2019

Related U.S. Application Data

(60) Provisional application No. 62/614,118, filed on Jan. 5, 2018.

(51) Int. Cl.

| | |
|---|---|
| ***H01Q 21/06*** | (2006.01) |
| ***H01Q 1/24*** | (2006.01) |
| ***H01Q 9/36*** | (2006.01) |
| ***H01Q 19/10*** | (2006.01) |
| ***H01Q 21/28*** | (2006.01) |
| ***H01Q 25/00*** | (2006.01) |
| ***H01Q 3/24*** | (2006.01) |
| ***H01Q 15/18*** | (2006.01) |
| ***H01Q 9/04*** | (2006.01) |

(52) U.S. Cl.

CPC ..... *H01Q 21/06* (2013.01); *H01Q 1/243* (2013.01); *H01Q 3/24* (2013.01); *H01Q 9/0485* (2013.01); *H01Q 9/36* (2013.01); *H01Q 15/18* (2013.01); *H01Q 19/106* (2013.01); *H01Q 21/28* (2013.01); *H01Q 25/00* (2013.01)

(58) Field of Classification Search

CPC ..... H01Q 1/243; H01Q 21/06; H01Q 21/28; H01Q 3/24; H01Q 15/18; H01Q 25/00; H01Q 9/0485; H01Q 19/106; H01Q 9/36

See application file for complete search history.

(56) References Cited

U.S. PATENT DOCUMENTS

| | | | | |
|---|---|---|---|---|
| 6,169,925 | B1 * | 1/2001 | Villaseca | A61N 1/37229 128/903 |
| 6,597,312 | B1 * | 7/2003 | Hrycak | H01Q 3/30 342/372 |
| 7,636,063 | B2 * | 12/2009 | Channabasappa | H01Q 9/0442 343/700 MS |
| 10,749,264 | B2 * | 8/2020 | Niakan | H01Q 1/2258 |
| 2005/0146470 | A1 | 7/2005 | Li et al. | |

(Continued)

FOREIGN PATENT DOCUMENTS

WO WO 2019/136255 A1 7/2019

OTHER PUBLICATIONS

International Search Report and Written Opinion for Application No. PCT/US2019/012356 dated Apr. 30, 2019.

*Primary Examiner* — Graham P Smith
*Assistant Examiner* — Jae K Kim
(74) *Attorney, Agent, or Firm* — Jenkins, Wilson, Taylor & Hunt, P.A.

(57) ABSTRACT

Devices, systems, and methods in which antenna elements are positioned together as an array at a corner of a mobile device, at least two of the antenna elements being oriented to provide beams in different directions with respect to the corner of the mobile device.

17 Claims, 12 Drawing Sheets

(56) References Cited

U.S. PATENT DOCUMENTS

| | | | | |
|---|---|---|---|---|
| 2005/0264461 | A1 | 12/2005 | Sugimoto et al. | |
| 2007/0080864 | A1* | 4/2007 | Channabasappa | H01Q 13/18 343/700 MS |
| 2007/0132642 | A1* | 6/2007 | Iluz | H01Q 21/065 343/700 MS |
| 2009/0109118 | A1 | 4/2009 | Ma et al. | |
| 2009/0128425 | A1 | 5/2009 | Kim et al. | |
| 2011/0018780 | A1* | 1/2011 | Tassoudji | H01Q 1/22 343/844 |
| 2013/0050052 | A1 | 2/2013 | Park et al. | |
| 2013/0315076 | A1* | 11/2013 | Zhao | H04B 7/082 370/252 |
| 2016/0028162 | A1* | 1/2016 | Ou | H01Q 1/2283 343/905 |
| 2016/0308563 | A1* | 10/2016 | Ouyang | H01Q 25/005 |
| 2017/0012349 | A1* | 1/2017 | Lee | H04B 1/44 |
| 2017/0133756 | A1* | 5/2017 | Eastburg | H01Q 9/0407 |
| 2017/0201011 | A1* | 7/2017 | Khripkov | H01Q 1/50 |
| 2017/0294705 | A1* | 10/2017 | Khripkov | H01Q 21/24 |
| 2017/0309991 | A1* | 10/2017 | Noori | H01Q 1/241 |
| 2018/0076529 | A1* | 3/2018 | Minard | H01Q 13/18 |
| 2018/0090816 | A1* | 3/2018 | Mow | H01Q 1/22 |
| 2018/0351235 | A1* | 12/2018 | Wang | H01Q 5/378 |
| 2019/0081387 | A1* | 3/2019 | Pandya | H04L 69/18 |
| 2019/0131705 | A1* | 5/2019 | Syrytsin | H01Q 21/28 |
| 2019/0165454 | A1* | 5/2019 | Lee | H01Q 21/062 |
| 2019/0229403 | A1* | 7/2019 | Yong | H01Q 1/48 |
| 2020/0021015 | A1* | 1/2020 | Yun | H01Q 21/24 |
| 2020/0144713 | A1* | 5/2020 | Jung | H04B 7/0617 |
| 2020/0244327 | A1* | 7/2020 | Bojer | H01Q 9/40 |
| 2020/0396871 | A1* | 12/2020 | Yun | H01Q 21/28 |

* cited by examiner

CORNER ANTENNA ARRAY DEVICES, SYSTEMS, AND METHODS

PRIORITY CLAIM

The present application claims priority to U.S. Patent Application Ser. No. 62/614,118, filed Jan. 5, 2018, the disclosure of which is incorporated herein by reference in its entirety.

TECHNICAL FIELD

The subject matter disclosed herein relates generally to mobile antenna systems and devices. More particularly, the subject matter disclosed herein relates to configurations for mobile devices having multiple antenna elements.

BACKGROUND

The fifth generation mobile communications network, also known as 5G, is expected to operate in several frequency ranges, including 3-30 GHz and even beyond 30 GHz. The 3-30 GHz band is known as the centimeter-wave band and the 30-300 GHz band is known as the millimeter-wave band. Using these frequency bands, 5G mobile communications networks are expected to provide significant improvements in data transmission rates, reliability, and delay, as compared to the current fourth generation (4G) communications network Long Term Evolution (LTE).

Because the wavelengths of signals in these frequency ranges are comparatively much shorter than traditional radio wave broadcasts, however, the signals can be more susceptible to being blocked or absorbed by obstacles. In the particular case of hand-held mobile devices, such obstacles can include the hand, head, and/or body of the user of the mobile device. As a result, in the development of devices for use in 5G networks, accounting for this blocking by the user can help avoid impeded device performance.

SUMMARY

In accordance with this disclosure, systems, devices, and methods for mobile communication are provided. In one aspect, an antenna element array is provided in which a plurality of antenna elements are configured to be positioned together as an array at a corner of a mobile device. At least two of the plurality of antenna elements are oriented to provide beams in different directions with respect to the corner of the mobile device.

In another aspect, a mobile communications system can include a plurality of antenna elements positioned together as an array at each corner of a mobile device, wherein at least two of the plurality of antenna elements at each corner are oriented to provide beams in different directions with respect to the respective corner of the mobile device, and wherein at least two antenna elements at different corners are oriented to provide beams in substantially similar directions with respect to the mobile device.

In another aspect, a method for operating an antenna element array for a mobile device can include positioning a plurality of antenna elements together as an array at a corner of a mobile device and providing beams from at least two of the plurality of antenna elements in different directions with respect to the corner of the mobile device.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

The present subject matter provides antenna arrays for the upcoming 5G generation of mobile communications. To help address the problem of signals being blocked or absorbed by obstacles, antenna arrays can be placed about a handset, such on the corners of mobile communications system, such as a mobile handset, which can help to ensure that at least one of them is not covered with the user's hand. Furthermore, in some embodiments, each antenna array includes a plurality of individual antenna elements. The different elements available in each array can provide several beams, at least two of which can be oriented to point in different directions. With such an arrangement, the system can be configured to identify the antenna element or elements that is unobstructed or can otherwise provide the best signal reception and selectively switch the receiver to those antenna elements. Such an arrangement can be used to realize a three-dimensional scan having larger coverage compared to conventional antenna arrangements.

Figure 1A:
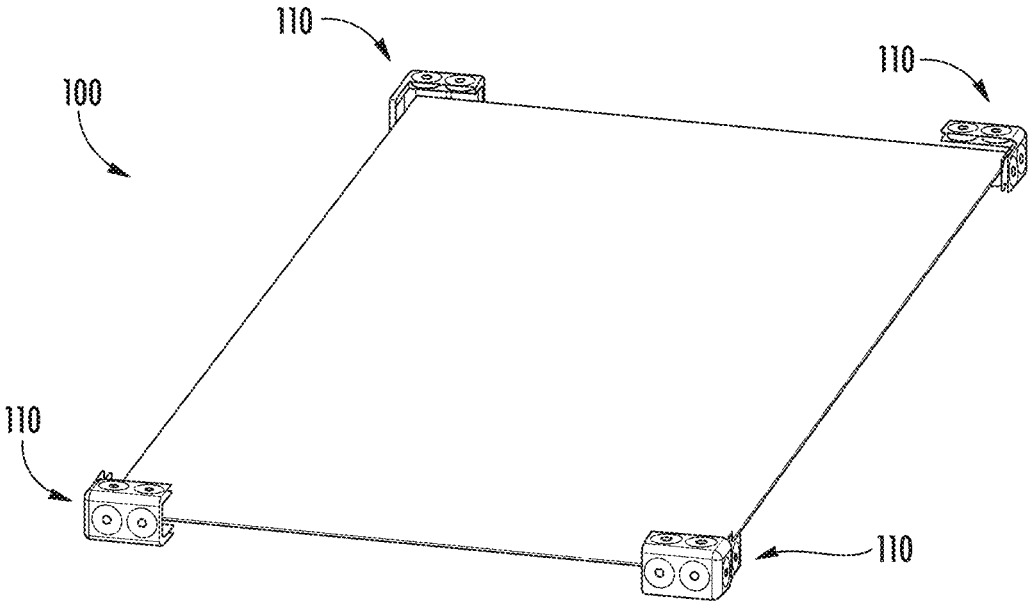
FIG. 1A is a perspective side view of an antenna array according to an embodiment of the presently disclosed subject matter.
Figure 1B:
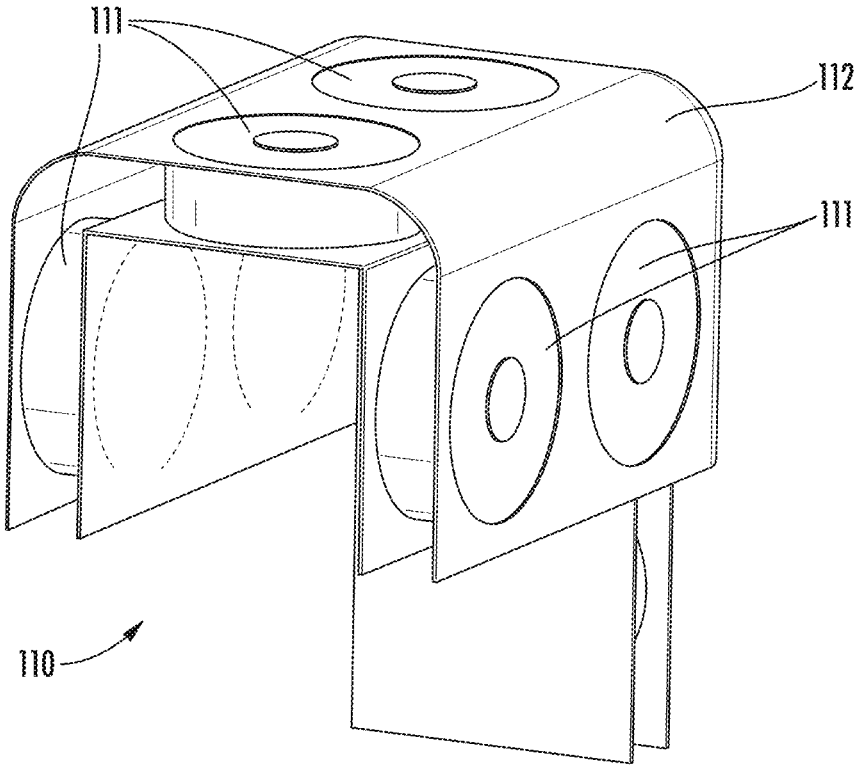
FIGS. 1B-1E are various views of a modified cube antenna array according to an embodiment of the presently disclosed subject matter.
Figure 1C:
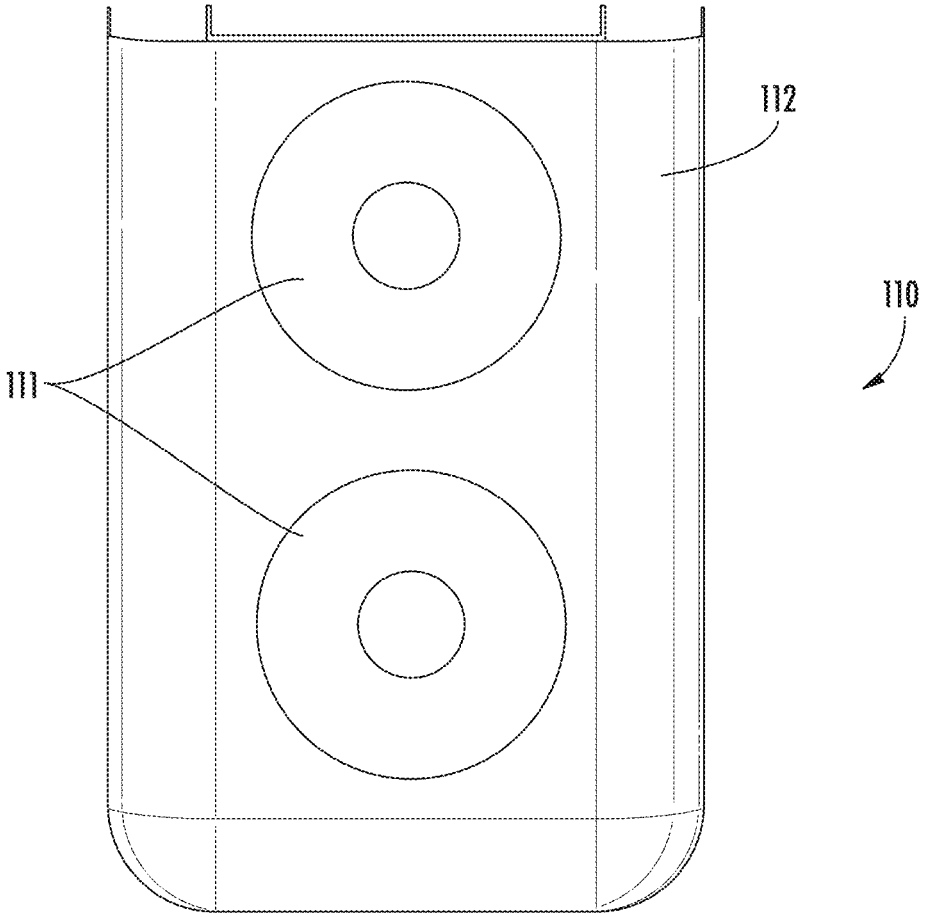
Figure 1D:
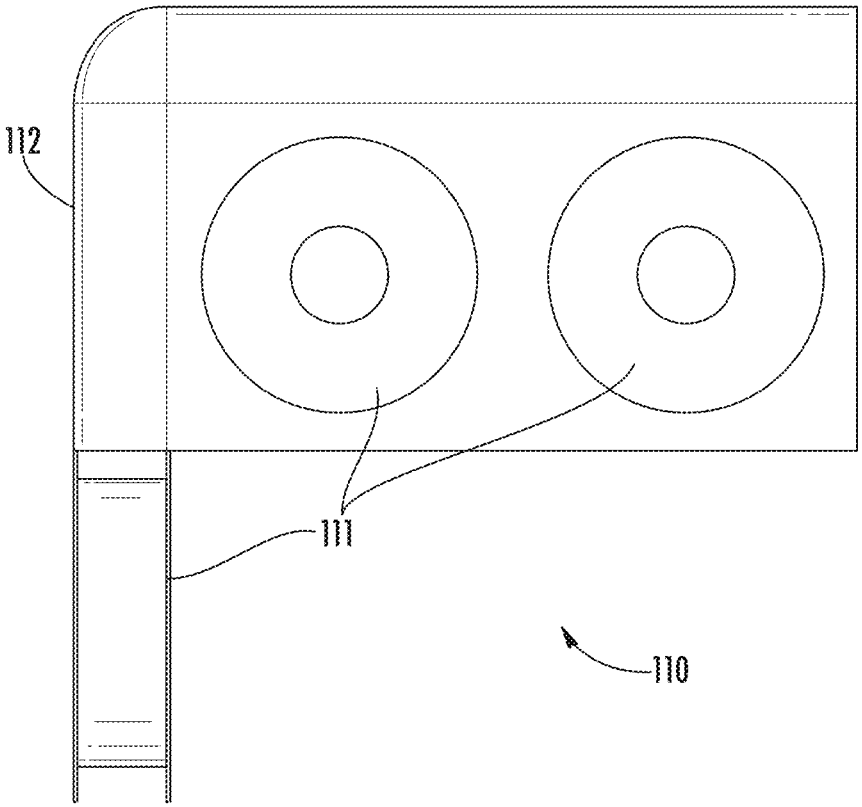
Figure 1E:
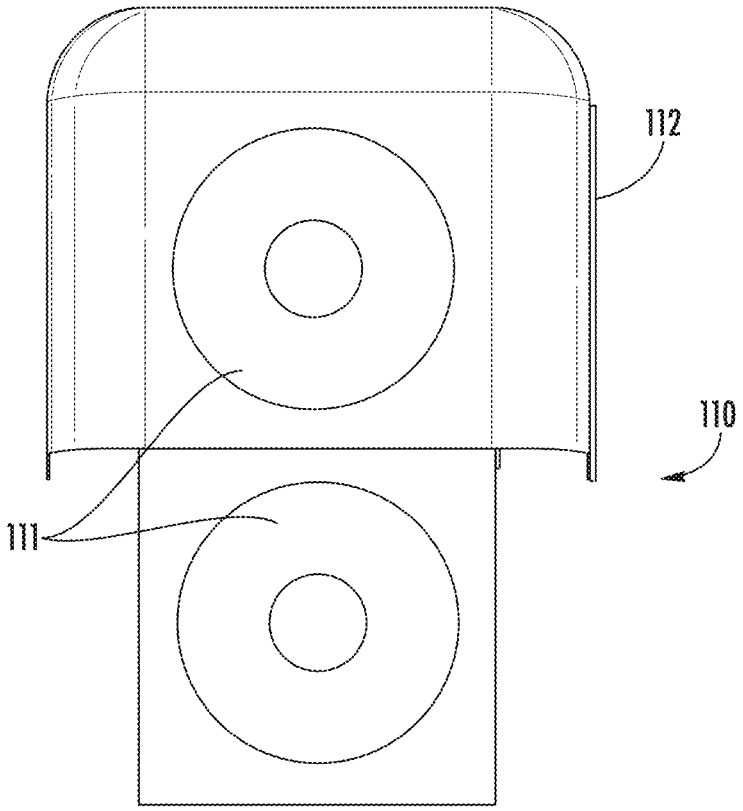

In one aspect, the present subject matter provides a mobile communications system comprising an antenna array that can be positioned about a mobile device as discussed above. As illustrated in FIG. 1A, for example, such an array can be provided in four antenna modules, generally designated 110, which are arranged at corners of a mobile device 100. Each module 110 includes one or more antenna element 111 integrated into each face of module 110. In the embodiment illustrated in FIGS. 1B through 1E, for example, two antenna elements 111 are provided on each face of each module 110 to thereby provide eight total antenna elements at each corner of device 100, with two on a "top" face, two on a "side" face, two on a "front" face, and two on a "back" face. In some embodiments, the two elements on each face are fed at the same time with the same phase, which can eliminate the need for phase shifters. That being said, those having ordinary skill in the art will recognize that, in other embodiments, the antenna elements on a given face can be fed with different phases. In some embodiments, for example, different elements can be provided with different phases that are offset with respect to one another, such as by having the feed to each element be of a different length. In such an arrangement, the system can create a beam that is off of broadside, particularly if two corners are used at one time. Even in this configuration, a tunable phase shifter is not required to steer the beam, as the beam associated with each element or pair of elements would still be fixed and switched.

Regardless of the particular feed configuration, having multiple elements on each face helps to achieve higher gain than individual elements alone. For example, in some embodiments, having two elements per face enables the system to achieve a gain higher than 7 dBi. Those having skill in the art will recognize that additional elements can be added to further improve the gain in a given direction, although this added gain comes at a cost of increasing the size of the antenna system module.

In addition, in some embodiments, mobile device 100 can be configured to provide switching among elements facing each direction to realize beam steering without applying phase shifters. This alternative form of beam steering can be advantageous since, using currently-available technology, the loss attributable to a switch at mm-wave communication frequencies can be much lower than the loss realized using phase shifters.

In some embodiments, each module 110 includes an array carrier 112 to which antenna elements 111 are mounted and that can be plugged onto a corner of mobile device 100. In some embodiments, an antenna array of this kind can be integrated into an antenna-in-package (AiP), such as by applying LTCC or other technologies. Those having ordinary skill in the art will recognize, however, that any of a variety of different numbers and arrangements of elements are contemplated by this kind of structure. In any configuration, by modularizing the antenna system, 5G functionality can be added to a mobile device by such a plug-in module. In addition, as discussed above, beam steering can be realized by switches instead of phase shifters.

Figure 2:
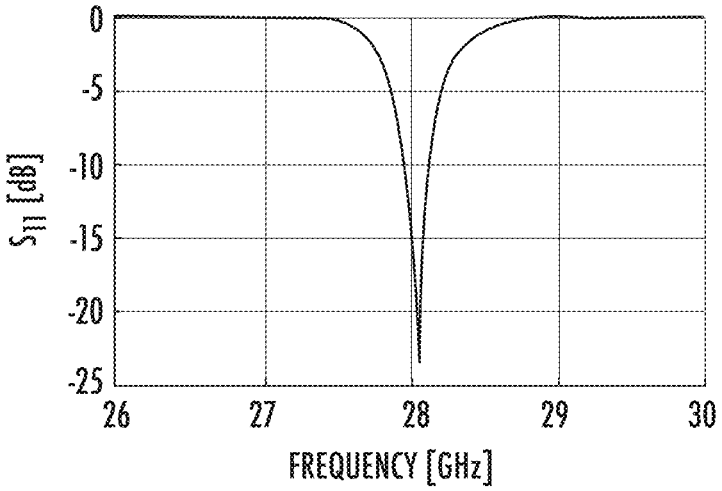
FIG. 2 is a graph of a reflection coefficient over a range of operating frequencies of an antenna array according to an embodiment of the presently disclosed subject matter.
Figure 3:
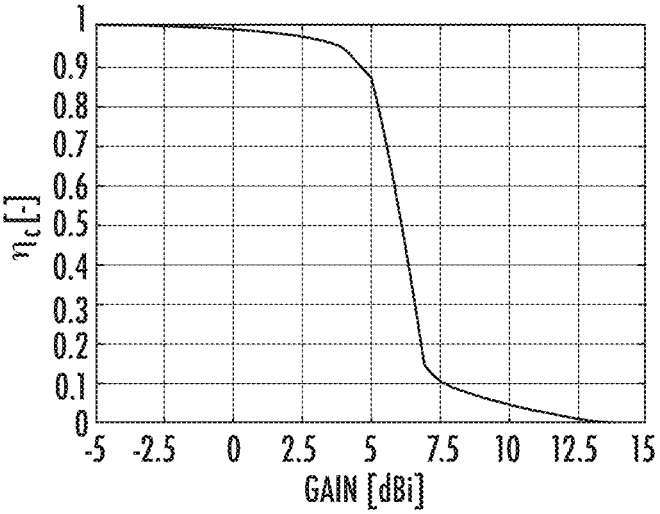
FIG. 3 is a graph of coverage efficiency of an antenna array according to an embodiment of the presently disclosed subject matter.
Figure 4:
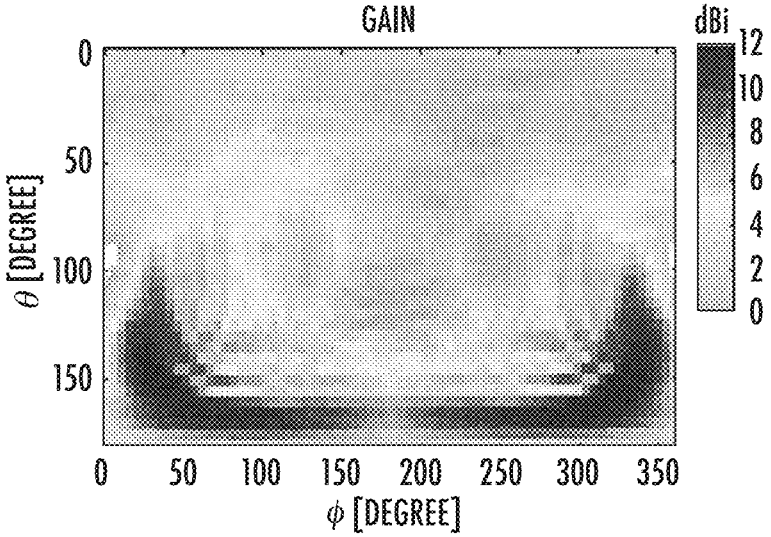
FIG. 4 is a graph showing a radiation pattern of an antenna array according to an embodiment of the presently disclosed subject matter.

In some embodiments, antenna elements 111 are dielectric-filled, cavity-backed microstrip patches. The use of such a cavity-backed configuration can provide an increase in bandwidth compared to conventional patch antennas. The geometry presented in FIGS. 1B-1E has overall dimensions of $5.14\times7.88\times7.88$ mm$^3$. In some embodiments, the substrate chosen presents a dielectric permittivity of $\epsilon_r=20$, and a thickness h=0.762 mm. Selecting a substrate having such a high permittivity allows the dimensions of the structure to be minimized. By comparison, if a dielectric having a permittivity of 10 is chosen, the gain would be higher, but the diameter of the patch and cavity would be larger as well. Using a high-permittivity substrate can provide a desirable balance of making the antenna small and high gain. In some embodiments, such as is shown in FIG. 2 for example, the resulting impedance bandwidth of module 110 is 320 MHz due to the high permittivity. The coupling between ports of the same face is −11.5 dB and between ports of different faces, almost −25 dB. The radiation of the two patches on each face is combined and the maximum gain achievable is 13.5 dB with a broad radiation pattern as indicated in FIGS. 3 and 4.

The particular characteristics of the cavity-backed antenna configuration can be adjusted, although changes to the design are understood to involve a trade-off between low-profile form factor and bandwidth. If a substrate with lower dielectric constant is employed in order to improve bandwidth, the size of the structure may become too big to be embedded in a mobile terminal.

Figure 5:
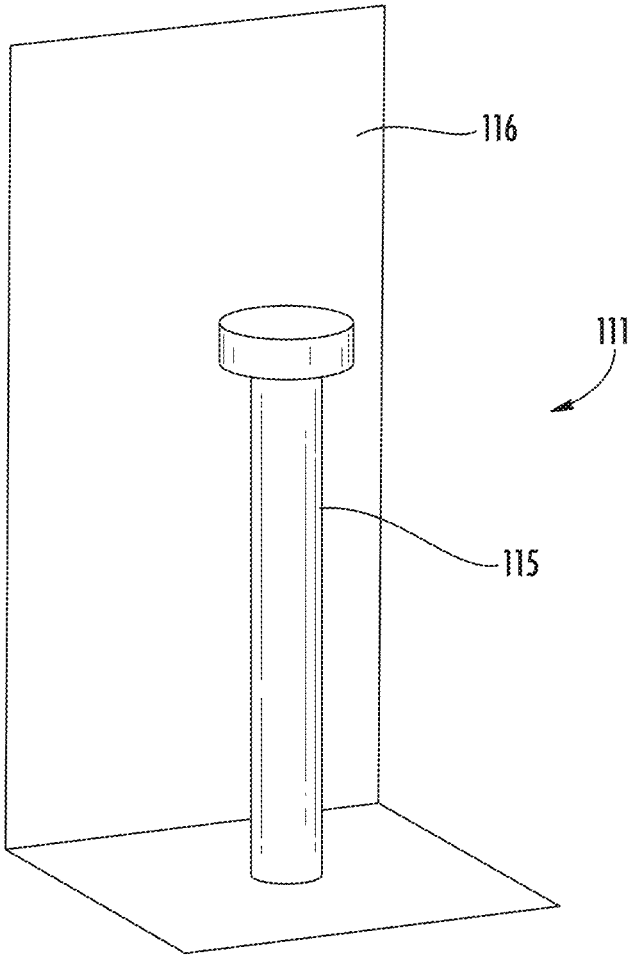
FIG. 5 is a perspective view of an antenna element including a top-loaded monopole with a reflector array according to an embodiment of the presently disclosed subject matter.
Figure 6:
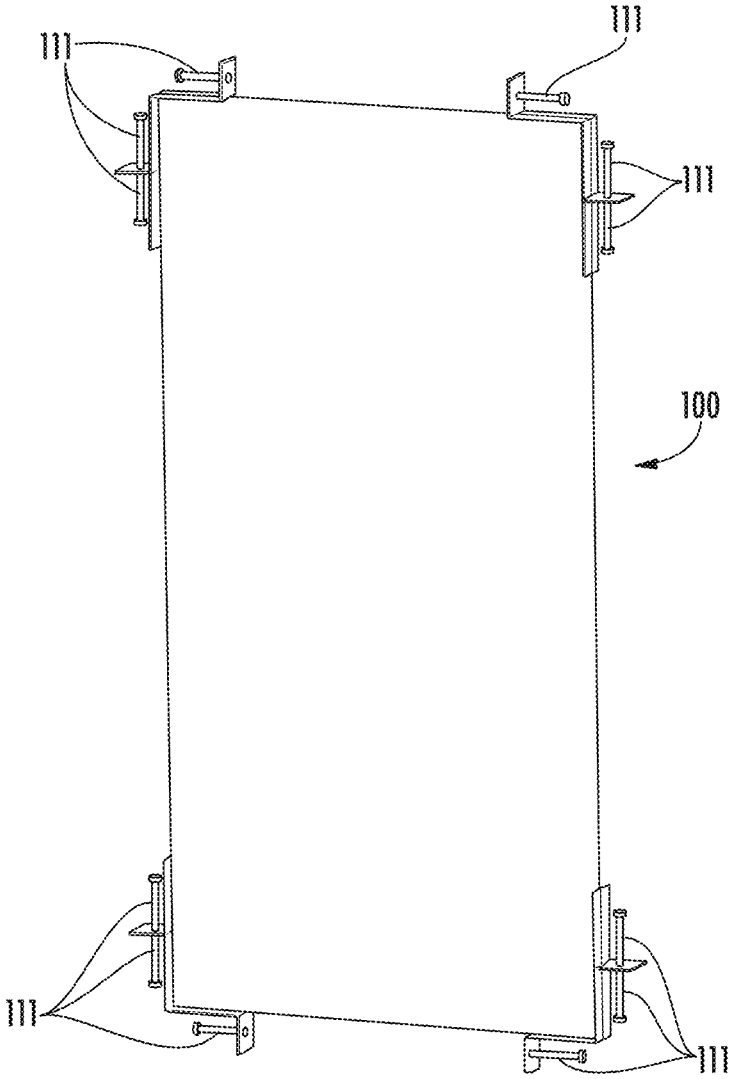
FIG. 6 is a perspective side view of an array of antenna elements positioned about the body of a mobile device according to an embodiment of the presently disclosed subject matter.
Figure 7:
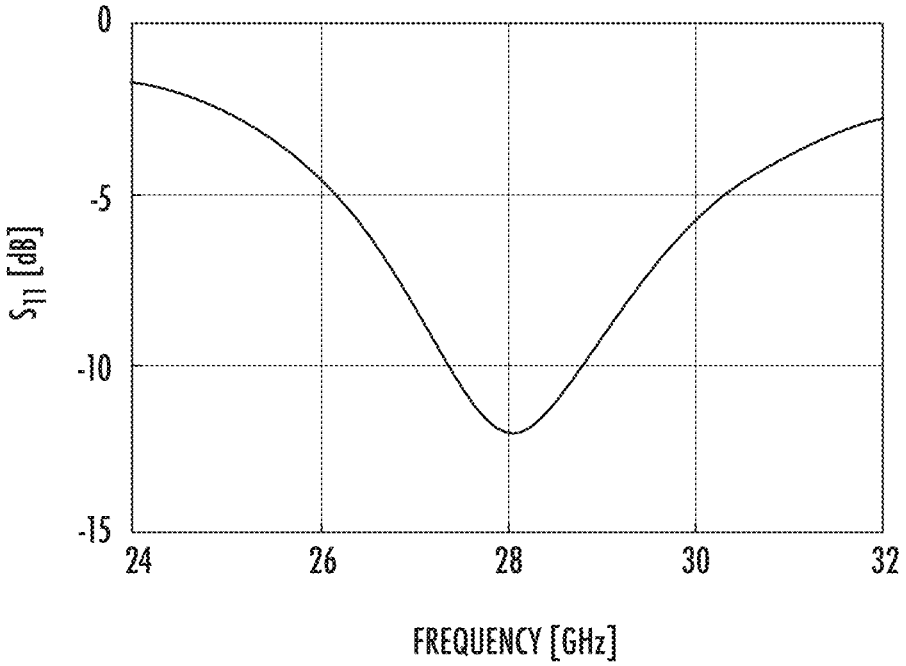
FIG. 7 is a graph of a reflection coefficient over a range of operating frequencies of an antenna array according to an embodiment of the presently disclosed subject matter.

Alternatively, in some other embodiments, antenna elements 111 are each provided as a top-loaded monopole 115 positioned near a reflector 116 rather than as a cavity-backed patch. FIGS. 5 and 6 illustrate an example of such a structure, with FIG. 5 showing an antenna element 111 having a single top-loaded monopole 115 with a reflector 116, and FIG. 6 showing an array of such antenna elements 111 being arranged about the body of mobile device 100. The placement and orientation of the antennas as shown in FIG. 6 is selected with the aim of achieving the maximum coverage with a minimum number of elements. In some embodiments, the dimensions of antenna elements 111 in this configuration are $5\times5\times10$ mm$^3$. Those having skill in the art will recognize that the ground plane size of monopole 115 can affect the performance. In addition, the length of monopole 115 can be reduced if desired, although the gain would also correspondingly be lowered. Antenna elements 111 in this configuration can be individually arranged about mobile device 100 as shown in FIG. 6, or they can be integrated together in a modular approach similar to that discussed above with respect to the embodiment of FIGS. 1A through 1E. As illustrated in FIG. 7, this arrangement can have an impedance bandwidth of 1.4 GHz. Although various embodiments of antenna elements 111 are disclosed above, those having ordinary skill in the art will recognize that the principles discussed herein are likewise applicable using other low-profile, compact, high-gain antenna designs.

Figure 8:
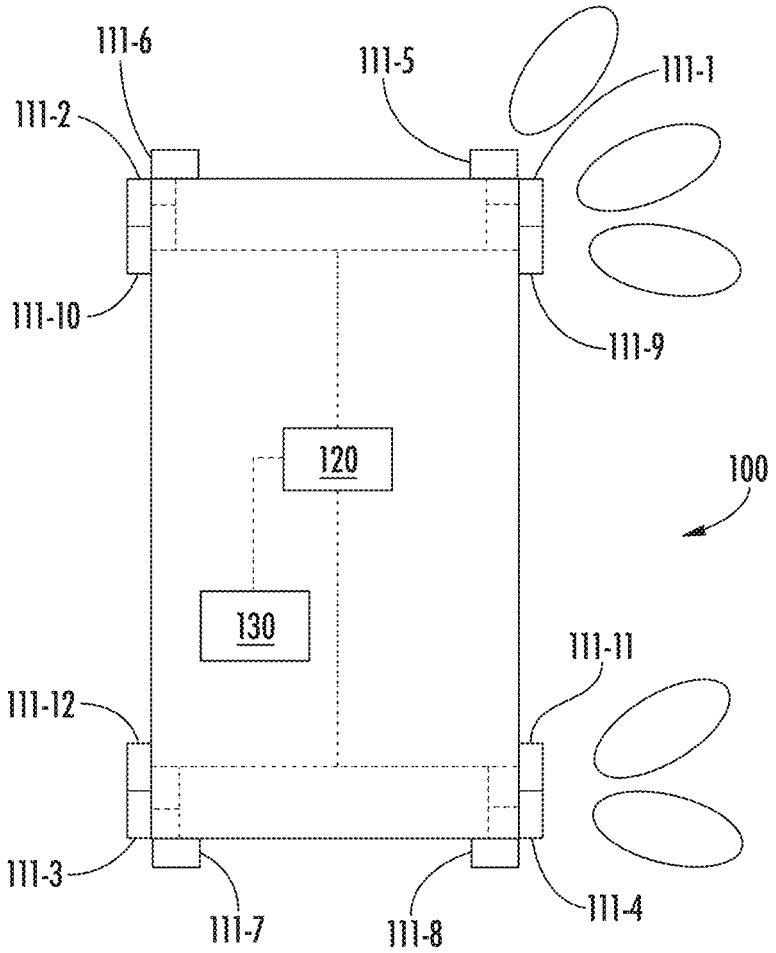
FIG. 8 is a plan view of an array of antenna elements positioned about the body of a mobile device according to an embodiment of the presently disclosed subject matter.

Regardless of the particular configuration of antenna elements 111, mobile device 100 can further be configured to select which of antenna elements 111 are active. FIG. 8 illustrates the relative directionality of the radiation patterns of the individual antenna elements 111 in an array according to one embodiment of the present subject matter. In some embodiments, a switch or other selection device, generally designated 120, that is configured to connect the plurality of antenna elements 111 to a receiver and/or transmitter, generally designated 130. Switch 120 is operable to select which of the plurality of antenna elements 111 are active. In some embodiments, switch 120 is operable to select two or more of the plurality of antenna elements 111 to be active at the same time. In this way, combinations of antenna elements 111 can be active to provide an aggregate coverage efficiency that is better than that of any one element alone. In addition, by activating multiple antenna elements that are spaced about mobile device 100, a degree of redundancy can be provided should any of the active elements be obstructed by the user.

Figure 9:
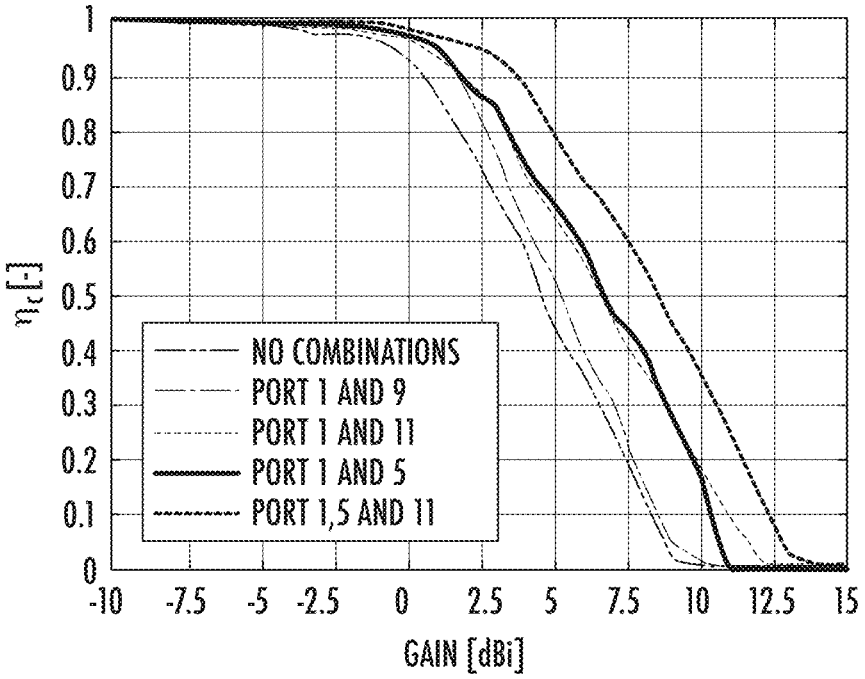
FIG. 9 is a graph of coverage efficiency of an antenna array in various operating states according to an embodiment of the presently disclosed subject matter.

Referring to the example configuration shown in FIG. 8, antenna elements 111 can be individually identified as first through twelfth antenna element 111-1 through 111-12. Combinations of elements can be selectively activated such that elements having similar directional orientations are activated together. For example, activating first antenna element 111-1 and ninth antenna element 111-9 together provides only a marginal improvement in the gain compared to the activation of either element alone. Selectively activating either the pair of first antenna element 111-1 and eleventh antenna element 111-11 or the pair of first antenna element 111-1 and fifth antenna element 111-5 translates to an increase of about 2.5 dBi to the gain. Further in this regard, since those two combinations behave well, a further step of activating all of first antenna element 111-1, fifth antenna element 111-5, and eleventh antenna element 111-11 together can improve the gain by around an additional 2 dBi. In FIG. 9, a comparison of the coverage efficiency between different combinations of elements fed at the same time is plotted.

Figure 10A:
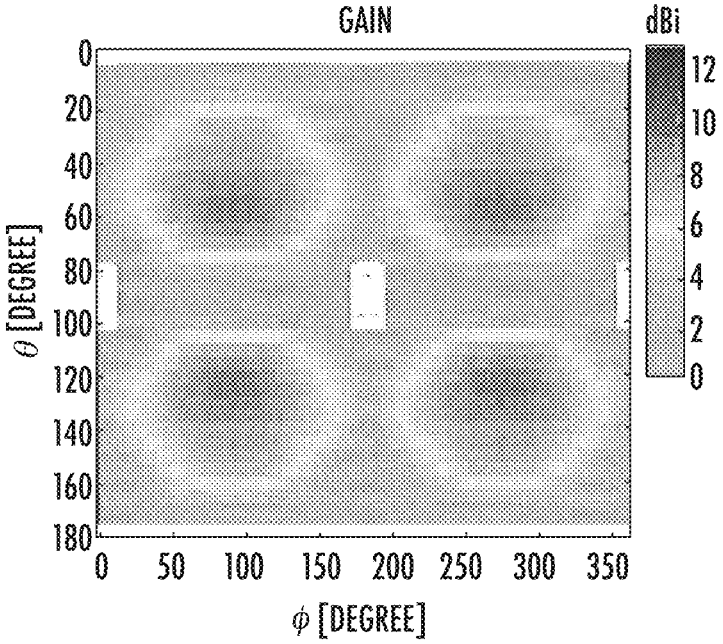
FIGS. 10A-10D are graphs illustrating radiation patterns of a mobile device incorporating an antenna array in various operating states according to an embodiment of the presently disclosed subject matter.
Figure 10B:
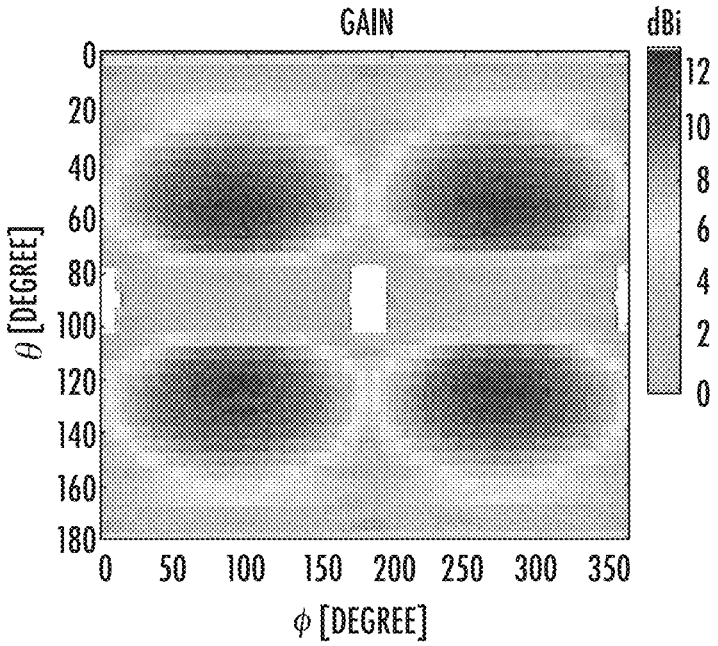
Figure 10C:
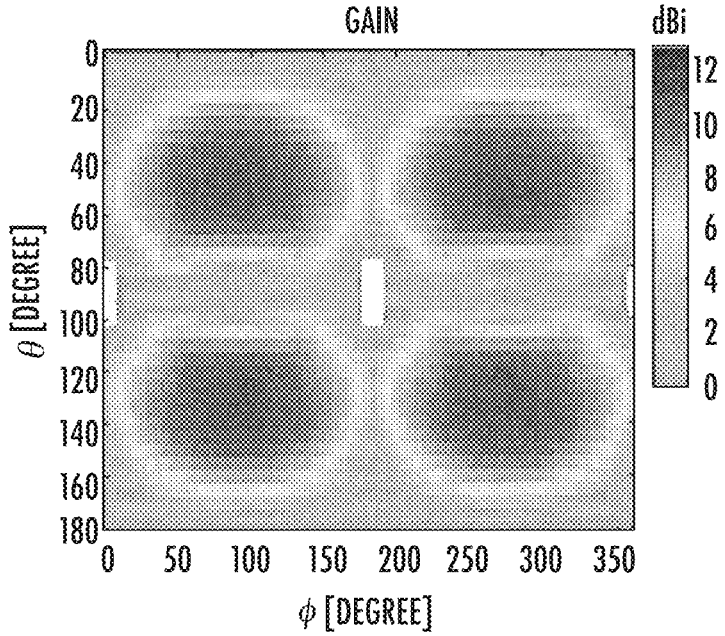
Figure 10D:
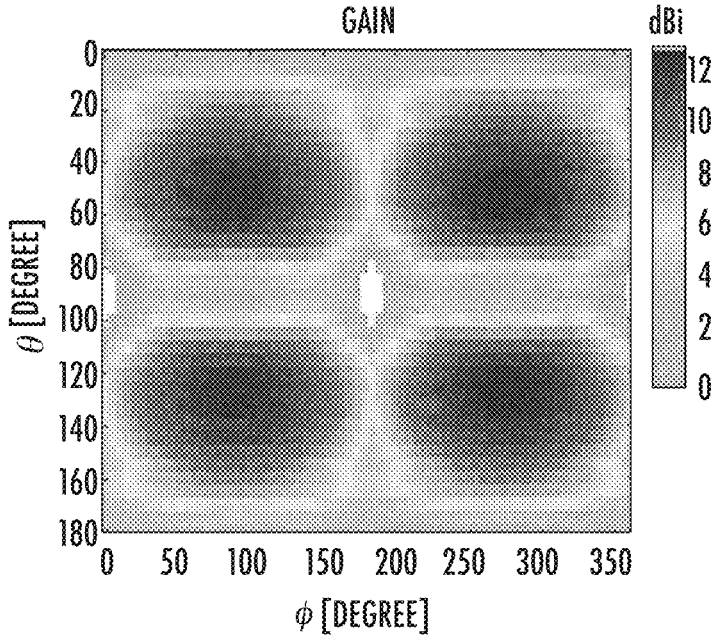

The radiation pattern of these combinations is depicted in FIGS. 10A-10D. In particular, referring again to the identification of elements used for FIG. 8, FIG. 10A illustrates the combined activation of first antenna element 111-1 and ninth antenna element 111-9, FIG. 10B illustrates the combined activation of first antenna element 111-1 and eleventh antenna element 111-11, FIG. 10C illustrates the combined activation of first antenna element 111-1 and fifth antenna element 111-5, and FIG. 10D illustrates the combined activation of first antenna element 111-1, fifth antenna element 111-5, and eleventh antenna element 111-11. Among these combinations, the three-port combination illustrated in FIG. 10D is the one that exhibits the best performance, with a peak gain of about 13.2 dBi. In addition, the performance can further be adjusted by changing the number of antenna elements, their positioning and/or orientation, or by controlling the communication between the antenna elements and the receiver and/or transmitter. For example, it is possible to cover the points of the space where $\theta=0$ by changing the phase between the elements. To cover the points where $\theta=90$, a dipole should be added at the center of the terminal.

That being said, if the separation between the elements is more than $\lambda/2$, the sidelobes become significant. Moreover, adding elements pointing in opposite directions increases the complexity of the feeding network without providing any gain advantage. Accordingly, combinations such as those discussed above in which that active antenna elements are located at or near the same corner are thought to provide valuable improvements in gain without introducing other significant issues. Such an arrangement further allows each corner module to be substantially independent.

Regardless of the configuration of the antenna array or the particular combinations of antenna elements activated for a given configuration, those having ordinary skill in the art will recognize that improved performance can be realized by aggregating the operation of multiple antenna elements that are spaced about mobile device 100. Again, using an array that can provide several beams, at least two of which can be oriented to point in different directions, the system can be configured to selectively switch the receiver to those antenna elements that are unobstructed or can otherwise provide the best signal reception. Such an arrangement can be used to realize a three-dimensional scan having larger coverage compared to conventional antenna arrangements.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. An antenna element array for a mobile device comprising:

a plurality of antenna elements that are configured to be positioned together as an array at a corner of a mobile device, wherein the corner comprises a region of the mobile device that is near each of a front face, a back face that is spaced apart from the front face, a first side that extends between the front face and the back face, and a second side that extends between the front face and the back face at an angle relative to the first side;

wherein one or more antenna elements of the plurality of antenna elements is configured to be integrated into each of the front face, the back face, the first side, and the second side of the mobile device; and wherein at least two of the plurality of antenna elements are oriented to provide beams in different directions with respect to the corner of the mobile device.

2. The antenna element array of claim 1, wherein each of the plurality of antenna elements comprises a cavity-backed microstrip patch.

3. The antenna element array of claim 1, wherein two of the plurality of antenna elements are configured to be integrated into each of the front face, the back face, the first side, and the second side of the corner of the mobile device;

wherein the two of the plurality of antenna elements on each of the front face, the back face, the first side, and the second side are configured to be fed a common phase.

4. The antenna element array of claim 1, wherein two of the plurality of antenna elements are configured to be integrated into each of the front face, the back face, the first side, and the second side of the corner of the mobile device;

wherein the two of the plurality of antenna elements on each of the front face, the back face, the first side, and the second side are configured to be fed different phases that are offset from one another.

5. The antenna element array of claim 1, wherein each of the plurality of antenna elements comprises:

a top-loaded monopole antenna element; and one or more reflector positioned to orient the beam at the antenna element in a desired direction.

6. The antenna element array of claim 1, comprising a switch configured to connect the plurality of antenna elements to a receiver or transmitter;

wherein the switch is operable to select which of the plurality of antenna elements are active.

7. The antenna element array of claim 6, wherein the switch is operable to select two or more of the plurality of antenna elements to be active at the same time.

8. A mobile communications system comprising:

a plurality of antenna elements positioned together as an array at each of one or more corner of a mobile device, wherein each corner comprises a region of the mobile device that is near each of a front face, a back face that is spaced apart from the front face, a first side that extends between the front face and the back face, and a second side that extends between the front face and the back face at an angle relative to the first side;

wherein one or more antenna elements of the plurality of antenna elements is configured to be integrated into each of the front face, the back face, the first side, and the second side of each respective one of the one or more corner of the mobile device;

wherein at least two of the plurality of antenna elements at each of the one or more corner are oriented to provide beams in different directions with respect to the respective corner of the mobile device; and wherein at least two antenna elements at different corners are oriented to provide beams in substantially the same direction with respect to the mobile device.

9. The mobile communications system of claim 8, comprising a switch connecting the plurality of antenna elements to a receiver or transmitter;

wherein the switch is operable to select which of the plurality of antenna elements are active.

10. The mobile communications system of claim 9, wherein the switch is operable to select two or more of the plurality of antenna elements to be active at the same time.

11. A method for operating an antenna element array for a mobile device, the method comprising:

positioning a plurality of antenna elements together as an array at a corner of a mobile device, wherein the corner comprises a region of the mobile device that is near each of a front face, a back face that is spaced apart from the front face, a first side that extends between the front face and the back face, and a second side that extends between the front face and the back face at an angle relative to the first side; and providing beams from at least two of the plurality of antenna elements in different directions with respect to the corner of the mobile device;

wherein positioning the plurality of antenna elements together comprises integrating the plurality of antenna elements into each of the front face, the back face, the first side, and the second side of the corner of the mobile device.

12. The method of claim 11, wherein each of the plurality of antenna elements comprises a cavity-backed microstrip patch.

13. The method of claim 11, wherein integrating the plurality of antenna elements into each of the front face, the back face, the first side, and the second side of the corner of the mobile device comprises integrating two of the plurality of antenna elements into each of the front face, the back face, the first side, and the second side of the corner of the mobile device; and feeding a common phase to the two of the plurality of antenna elements on each of the front face, the back face, the first side, and the second side.

14. The method of claim 11, wherein integrating the plurality of antenna elements into each of the front face, the back face, the first side, and the second side of the corner of the mobile device comprises integrating two of the plurality of antenna elements into each of the front face, the back face, the first side, and the second side of the corner of the mobile device; and feeding different phases to the two of the plurality of antenna elements on each of the front face, the back face, the first side, and the second side.

15. The method of claim 11, wherein each of the plurality of antenna elements comprises:

a top-loaded monopole antenna element; and one or more reflector positioned to orient the beam at the antenna element in a desired direction.

16. The method of claim 11, comprising selecting which of the plurality of antenna elements are active.

17. The method of claim 16, wherein selecting which of the plurality of antenna elements are active comprises selecting two or more of the plurality of antenna elements to be active at the same time.

* * * * *